US006223573B1

(12) United States Patent
Grewal et al.

(10) Patent No.: US 6,223,573 B1
(45) Date of Patent: May 1, 2001

(54) METHOD FOR PRECISION TEMPERATURE CONTROLLED HOT FORMING

(75) Inventors: Sukhminder S. Grewal, New Haven, CT (US); Stephen R. Demichele, Pittsford; Richard L. Couture, Castleton, both of VT (US)

(73) Assignee: General Electric COmpany, Cincinnati, OH (US)

( * ) Notice: Subject to any disclaimer, the term of this patent is extended or adjusted under 35 U.S.C. 154(b) by 0 days.

(21) Appl. No.: 09/340,271

(22) Filed: Jun. 25, 1999

(51) Int. Cl.[7] ..... B21C 51/00

(52) U.S. Cl. ..... 72/19.1; 72/18.3; 72/37; 72/342.5; 72/364

(58) Field of Search ..... 72/16.1, 16.2, 72/16.5, 17.3, 18.1, 18.3, 19.1, 342.5, 342.6, 342.94, 352, 358, 364, 37; 29/889, 889.6, 889.7

(56) References Cited

U.S. PATENT DOCUMENTS

| | | | | |
|---|---|---|---|---|
| 2,382,339 | | 8/1945 | Skowron et al. . | |
| 3,713,320 | * | 1/1973 | Andresen | 72/361 |
| 3,988,913 | | 11/1976 | Metcalfe et al. . | |
| 4,055,975 | | 11/1977 | Serfozo et al. . | |
| 4,321,818 | | 3/1982 | Bessho . | |
| 4,466,266 | | 8/1984 | Gardner et al. . | |
| 4,479,293 | | 10/1984 | Miller et al. . | |
| 4,527,410 | | 7/1985 | MacNitt, Jr. et al. . | |
| 4,665,785 | | 5/1987 | Thurner . | |
| 4,712,404 | | 12/1987 | Crout et al. . | |
| 4,772,801 | * | 9/1988 | Fornerod et al. | 72/17.3 |
| 5,168,737 | * | 12/1992 | Streefland et al. | 72/17.3 |
| 5,515,705 | * | 5/1996 | Weldon et al. | 72/19.1 |
| 5,636,440 | * | 6/1997 | Bichon et al. | 29/889.72 |
| 5,933,951 | * | 8/1999 | Bergue et al. | 29/889.72 |

FOREIGN PATENT DOCUMENTS

1831398 * 7/1993 (SU) ..... 72/342.5

OTHER PUBLICATIONS

"Custom Trim Presses", Metal Mechanics, Inc., http://www.metalmechanics.com, Jun. 1, 1999.

* cited by examiner

*Primary Examiner*—Ed Tolan
(74) *Attorney, Agent, or Firm*—Andrew C. Hess; Gerry S. Gressel

(57) ABSTRACT

Methods and apparatus for operating a press, such as a forge or trim press, are directed at activating a ram in a press having a lower die and an upper die connected to a ram by heating a workpiece to a first temperature above an impact temperature. The workpiece then is placed on the lower die, monitored during chill down of the workpiece from the first temperature, and the ram actuated based upon the monitoring in a controlled manner to effect an impact of the upper die against the workpiece. The monitoring includes measuring a characteristic parameter of the workpiece and the actuating includes actuating the ram after a predetermined fixed value of the measured parameter is measured. The placing of the workpiece on the lower die is done manually in the preferred embodiment. In a more particular embodiment, the characteristic parameter is a contact time period of the workpiece with the lower die and the measuring includes starting to measure the contact time period of the workpiece with the lower die as soon as contact is made between the workpiece and the lower die, and actuating the ram to effect the impact occur at a predetermined fixed period of time after the contact is made.

17 Claims, 6 Drawing Sheets

METHOD FOR PRECISION TEMPERATURE CONTROLLED HOT FORMING

FIELD OF THE INVENTION

The present invention relates to the hot forming or forging of metals and, more particularly, in one aspect to methods and apparatus for forming metals which are difficult to process by conventional methods as well as those more readily formed metals. The term metal, as used herein, includes both elemental metals and alloys unless indicated otherwise.

DESCRIPTION OF RELATED ART

Numerous methods for the solid state forming of metallic workpieces or blanks into selected shapes include forging and rolling. Press forging and trimming are two widely used techniques in which the metal is worked at an elevated temperature such as for the formation of gas turbine engine blade airfoils. In a typical forging operation, an unformed workpiece is pre-heated to forging temperature and then shaped with a hammer or ram of a forge press. The unformed workpiece is typically a pre-form having an approximate shape to that of the formed workpiece. In a typical trimming operation, the formed workpiece is trimmed while still hot from the forging process and excess metal and/or flash formed during the forging process is trimmed using trimming dies and a hammer or ram of a trim press. The unformed workpiece is typically a pre-form having an approximate shape to that of the formed workpiece.

The hot forming or forging process requires a heated workpiece at a high temperature, typically above 1700° F. The forge dies, though often heated, are at a much lower temperature, typically less than 500° F. or even at room temperature. The large temperature differential and the high thermal diffusivity of the metals being forged causes a rapid heat transfer. The temperature of the workpiece in contact with the die drops in temperature at 100° F. per second or more. The thinner the workpiece the larger the relative effect of this temperature drop is. In the absence of any other reheating methods, the temperature of the workpiece continues to fall in a transient way until the ram of forge press impacts the upper die against the workpiece. Afterwards, the workpiece temperature continues to fall until the workpiece is removed from contact with the metal die or until it reaches the same temperature as the die. The trimming process is similar in that the formed workpiece is at a substantially higher temperature than the trim dies.

The physical properties of the workpiece material at time of impact of the forge press on the workpiece are a strong function of the temperature at time of impact. These physical properties contribute to the results of the forging process in terms of extent of deformation achieved with a specific forge force as well as the flow of material caused by the forge forces. In addition there is heat generated in the material during deformation caused by the plastic deformation which also effects the results of the forging process. A similar situation exists for the trimming process as regards the deformation in terms of change in shape of the workpiece. This deformation is relating minor compared to that during forging. On the other hand, the trim size itself and the orientation of features of the workpiece relative to each other can be significantly effected.

The conditions of the workpiece at the exact instant of impact by the ram are determined by the transient temperature distribution through the workpiece which in turn is determined by the heat transfer from the workpiece to the die. The heat transfer depends on two parameters, (1) the heat transfer coefficient or resistance to the heat transfer from the workpiece to the die and (2) the time of contact with the colder die during which the heat transfer takes place.

Variations in these two parameters during the forging and trimming processes effect repeatability of the processes and hence the consistency of the parts that are forged and trimmed. It is very desirable to have a high degree of repeatability in forging and trimming processes and forged and trimmed parts that are more consistent.

The variation in the heat transfer coefficient and the time of contact causes substantial variations between parts in the temperature profile in the workpiece and thereby causes variation in the shape and form of the product. This variation is significant because the precision required in gas turbine engine and, in particular, aircraft gas turbine engine airfoils. Various corrective actions are currently used in forge shops to reduce these variations. Adjustments of other press and forming parameters, benching and changing the shape of the dies, subsequent cold working and hot working, chemical metal removal are all used to reduce part-to-part variation to meet tolerance requirements. These corrective operations increase the cost of production and inventory and also increase the cycle time for making the part.

Any variation in the temperature of the workpiece at instant of impact during operation of trim and forge presses effects the stress and deformation of the workpiece which then causes a variation in the orientation of portions of the part. In the case of an airfoil of a gas turbine engine blade in addition to the variation in the shape of the part, it also causes variations in the orientation of the airfoil with respect to the dovetail and platform. In the trim process it also causes variations in the chord length of the airfoil. These variations cause difficulty in meeting the tolerance requirement of the component. Subsequent operations to manually bench or deform the part to conform to the orientation required and to grind the chord length add to the cost of the part, time to produce it, and increases inventory. For the precision required in aviation airfoils this variation causes substantial cost increases. For very large variations, the current practice requires adjustments or other press and forming parameters.

Another factor that effects repeatability or part-to-part variation is the additional variability due to operators working at different speeds and variations during the shift of same operator. These differences cause both the time of contact and the heat transfer coefficient to vary with consequent variation in the part geometry. There is a need to reduce part-to-part variation in the forging and trimming processes using presses and improve consistency of hot formed parts made with forge and trim presses.

SUMMARY OF THE INVENTION

The invention includes methods and apparatus for forging and trimming with forge and trim presses.

A method for activating a ram in a press having a lower die and an upper die connected to a ram includes heating a workpiece to a first temperature above an impact temperature, placing the workpiece on the lower die, monitoring the workpiece during chill down of the workpiece from the first temperature, and actuating the ram based upon the monitoring in a controlled manner to effect an impact of the upper die against the workpiece. In one embodiment of the present invention, the monitoring includes measuring a characteristic parameter of the workpiece and the actuating includes actuating the ram after a predetermined fixed value of the measured parameter is measured. The placing of the workpiece on the lower die is done manually in the preferred embodiment.

In a more particular embodiment, the characteristic parameter is a contact time period of the workpiece with the lower die and the measuring includes starting to measure the contact time period of the workpiece with the lower die as soon as contact is made between the workpiece and the lower die, and actuating the ram to effect the impact occur at a predetermined fixed period of time after the contact is made. More particularly, an operator manually places the workpiece on the lower die with a holding tool, has the tool make and stay in contact with a wire near the lower die as the workpiece is placed onto the lower die, and initiates starting to measure the contact time period by completing an electrical starting circuit from the wire through the tool, the workpiece, and the lower die.

In another embodiment, the characteristic parameter is an actual transient temperature and the measuring comprises measuring the transient temperature with an infrared detector aimed at a predetermined and fixed position on the workpiece, and actuating the ram to effect the impact after a predetermined fixed temperature is sensed by the infrared detector. Another embodiment method uses a location of the workpiece on the lower die as the characteristic parameter and the measuring includes detecting whether the workpiece is at a predetermined and fixed location on the lower die, and actuating includes actuating the ram to effect the impact after the workpiece is at the predetermined and fixed location on the lower die. An electric eye is used in a more particular embodiment to detect when the workpiece is at the predetermined and fixed location on the lower die and to then start a timer to actuate the ram to effect the impact at a predetermined fixed period of time after the timer starts. Preferably, the embodiment includes breaking a light curtain of the electric eye during the placing of the workpiece on the lower die to start the monitoring and the timer is started by re-establishing the light curtain after placing the unformed workpiece on a lower die.

A press apparatus for forming a workpiece includes a press having spaced apart lower and upper dies, a ram operably connected to the upper die, a measuring means for measuring a characteristic parameter of the unformed workpiece on the lower die, and a control means for actuating the ram to effect an impact of the upper die against the workpiece after a predetermined fixed value of the measured parameter is measured. In one embodiment, the characteristic parameter is a contact time period of the workpiece with the lower die and the measuring means includes a timing means for starting to measure the contact time period of the workpiece with the lower die as soon as contact is made between the workpiece and the lower die. The control means is operable to actuate the ram to effect the impact at a predetermined fixed period of time after the first contact is made.

In a more particular embodiment, a wire is located near the lower die. An electrical starting circuit including the wire starts the timing means after the circuit is completed when a holding tool with which an operator manually places the workpiece on the lower die makes and stays in contact with the wire as the workpiece is placed onto the lower die completing a circuit having in serial relationship, the wire, the tool, the workpiece, and the die.

In another embodiment, the characteristic parameter is an actual transient temperature and the measuring means includes an infrared detector aimed to locate a predetermined and fixed position on the workpiece. The control means is operable for actuating the ram to effect the impact after the predetermined fixed temperature is sensed by the infrared detector.

In yet another embodiment, the characteristic parameter is a location of the workpiece on the lower die and the measuring means includes a location detecting means for detecting whether the workpiece is at a predetermined and fixed location on the lower die. The control means is operable to actuate the ram to effect the impact after the workpiece is detected at the predetermined and fixed location on the lower die. In a more particular embodiment, the location detecting means includes an electric eye. The control means is operable to detect when the workpiece is at the predetermined and fixed location on the lower die and start a timer. The timer is operable to actuate the ram to effect the impact at a predetermined fixed period of time after the timer starts. Preferably, the control means is operable to detect a breaking of a light curtain of the electric eye when the workpiece is placed on the lower die and starting the timer when the light curtain is re-established after the workpiece is placed on the lower die.

ADVANTAGES

The main advantages of the present invention is to make forging and trimming processes more repeatable so that the parts that are forged and trimmed are more consistent. The invention reduces variation in the shape and form of parts and is particularly significant to meet the precision required in the production of aviation airfoils. It replaces various corrective actions that are currently used in forge shops to reduce part-to-part variation to meet tolerance requirements. These actions include; adjustments of other press and forming parameters, benching and changing the shape of the dies, subsequent cold working and hot working, and chemical metal removal. These subsequent corrective operations increase the cost of production and inventory and also increase the cycle time for making the part.

The present invention reduces part-to-part variation due because of additional variability due to operators working at different speeds and variation during the shift of same operator.

With respect to trimming operations, the invention reduces variation in the trim region dimensions and in the orientation of portions of the part. In the case of an airfoil of a gas turbine engine blade it reduces variations in the orientation of the airfoil with respect to the dovetail and platform and in the chord length of the airfoil.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
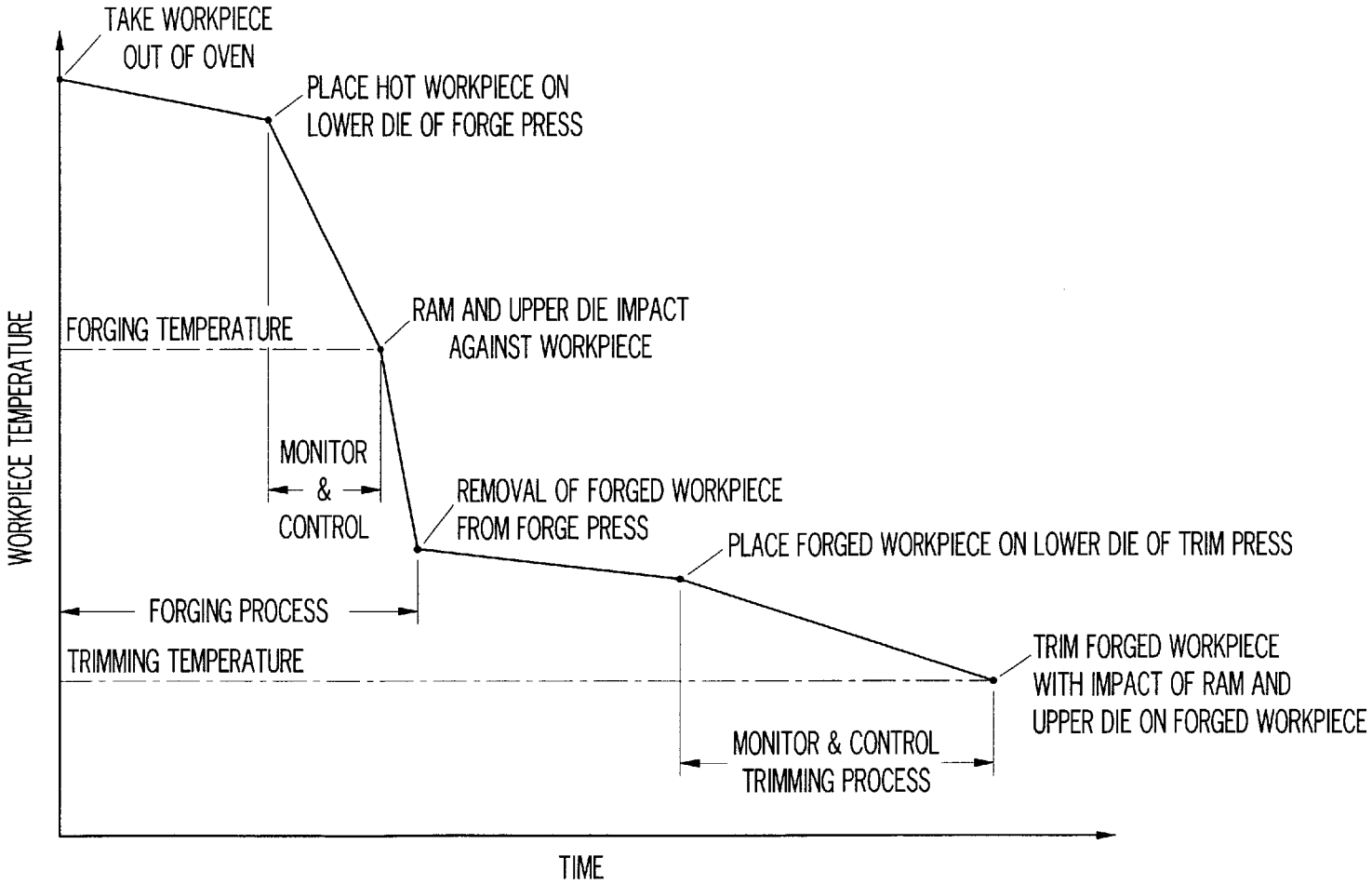
FIG. 1 is a graphical illustration of a method for forming and trimming a workpiece using an exemplary embodiment of the present invention.
Figure 2:
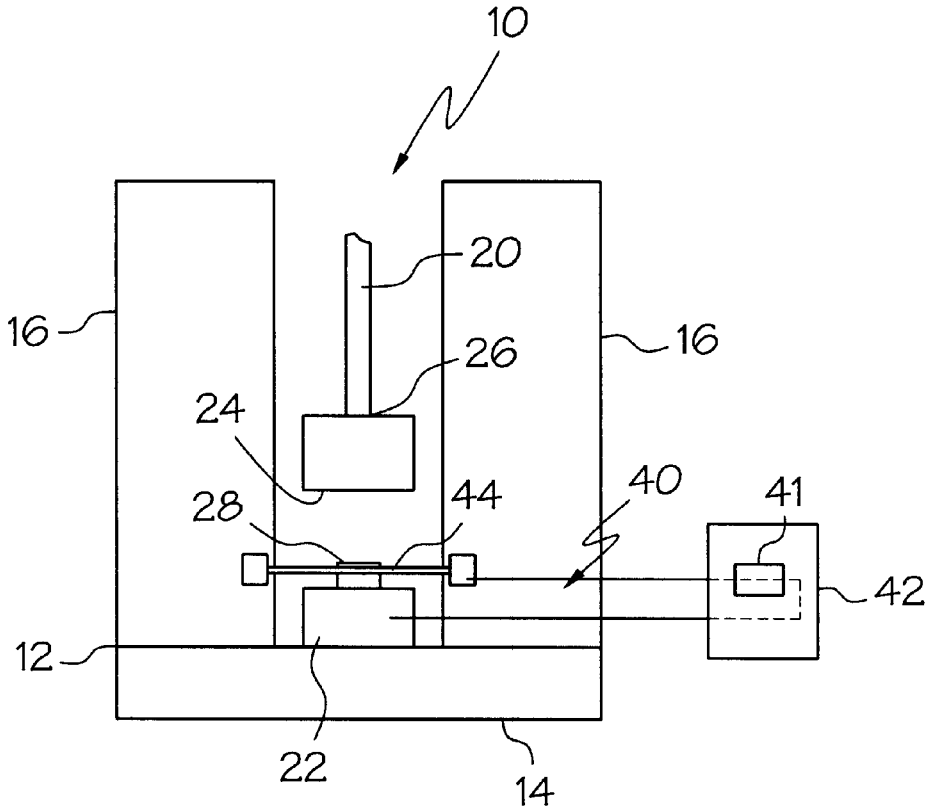
FIG. 2 is a front view schematical illustration of an exemplary embodiment of a forge press apparatus of the present invention.

The invention includes methods as graphically illustrated in FIG. 1 for operating a press apparatus 8 such as a forge press 10 schematically illustrated in FIG. 2. The press 10 has a frame 12 with a base 14 on the bottom of the frame and columns 16 extending upward that support a ram 20 operable to quickly move linearly in a downwardly direction with a great deal of force. A lower die 22 rests fixedly supported on the base 14 and an upper die 24 is mounted on a bottom portion 26 of the ram 20. A hot pre-formed or unformed workpiece 28 placed on the lower die 22 is impacted by the upper die 24 when the ram 20 is actuated.

Figure 4:
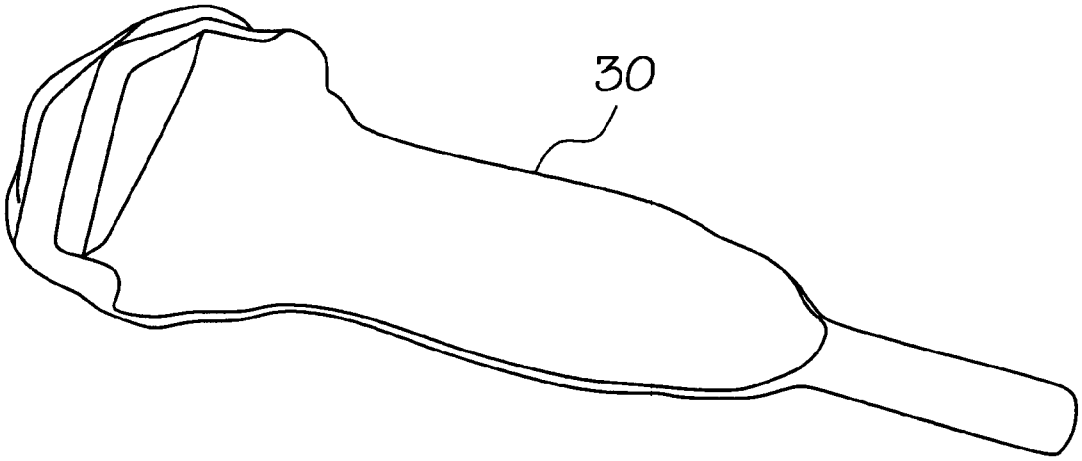
FIG. 4 is a perspective view of gas turbine engine blade forge pre-form exemplifying a workpiece used in the present invention as illustrated in FIG. 1.
Figure 5:
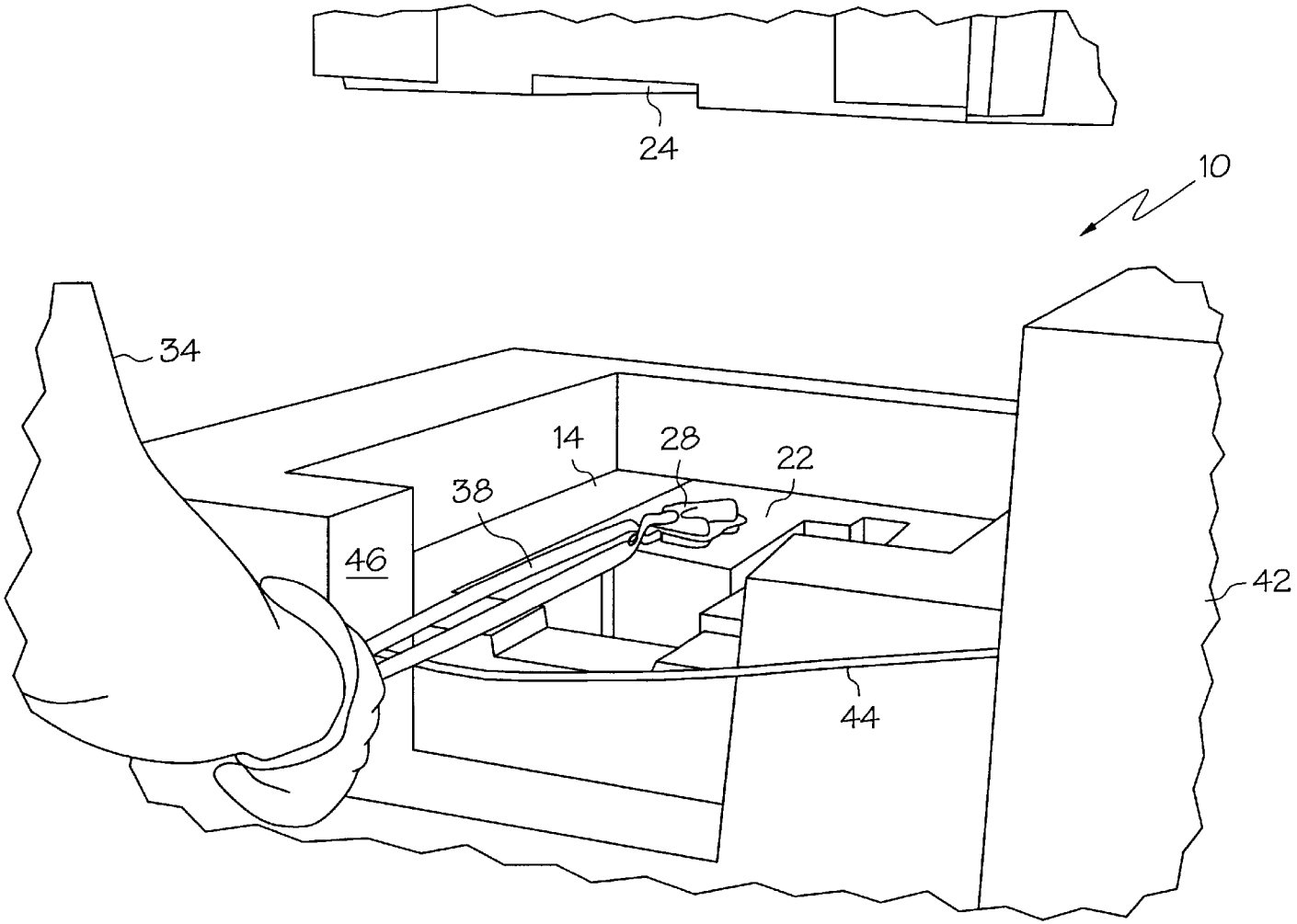
FIG. 5 is a perspective schematical illustration of a forge press including a wire for an electrical starting circuit of the press apparatus in FIG. 1.

Referring to FIGS. 1 and 2, the unformed workpiece 28 is heated in an oven (not shown) to a first temperature above a forging temperature and then shaped using the ram 20, also referred to as a hammer, of the forge press 10 to impact the upper die 24 on the workpiece. The unformed workpiece 28 is illustrated in FIG. 4 as a pre-form 30 of a gas turbine engine blade having an approximate shape to that of the formed workpiece. FIG. 5 illustrates the hot pre-formed workpiece 28, which has been manually removed from the oven by an operator 34 using a tool such as tongs 38 to hold the workpiece 28, being disposed in the lower die 22. Using the tongs 38, the operator manually places the workpiece on the lower die 22 of the forge press 10. Though the lower die may be pre-heated, it is well below the temperature of the hot workpiece 28 and the forging temperature. In one exemplary forging operation, the forging temperature is about 1700° F. and the lower die is pre-heated to about 500° F.

The temperature of the unformed workpiece in contact with the lower die drops at a rate of about in temperature at 100° F. per second or more during a time period referred to as chill down as illustrated in FIG. 1. The relative effect on the quality of the forging process is larger, the thinner the workpiece. In the absence of any other reheating methods, the temperature of the workpiece continues to fall in a transient way until the upper die 24 of the forge press 10 impacts the workpiece 28 at the end of chill down. After impact of the upper die 24 against the workpiece 28, the temperature of the workpiece continues to fall as well until the workpiece is removed from contact with the metallic lower die 22 or until it reaches the same temperature as the lower die. The present invention monitors the unformed workpiece 28 in the lower die 22 and controls actuation of the ram 20 to which is attached to the upper die 24.

The present invention actuates the ram 20 in a controlled manner based upon the monitoring of the unformed workpiece on the lower die to effect an impact of the upper die 24 against the workpiece 28. The workpiece 28 is, in the exemplary embodiment, the preform 30 for a blade of a gas turbine engine and the forging process forms the airfoil of the blade. After forging the formed workpiece 28 is removed form the forge press 10 and while still hot, it is placed onto the lower die 22 of a trim press not separately illustrated but which in operation and schematically resembles that of the forge press 10. The ram 20 of the trim press is also actuated in a controlled manner based upon the monitoring of the now formed workpiece 28 on the lower die 22 of the trim press to effect an impact of the upper die 24 of the trim press against the formed workpiece 28 to trim off excess material such as flash from the airfoil of the formed workpiece. The trim dies are generally at room temperature.

Figure 3:
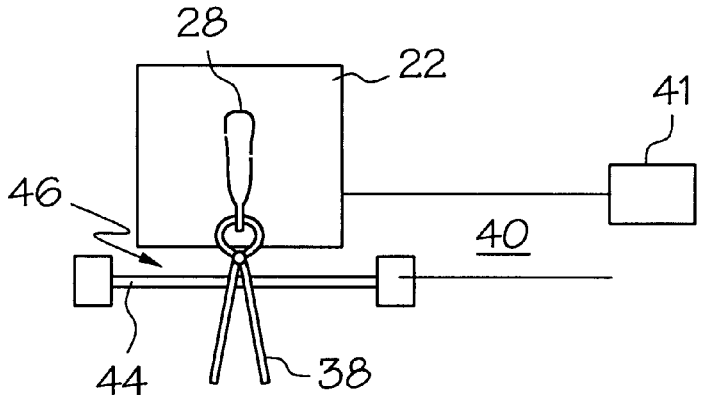
FIG. 3 is a top view schematical illustration of part of the press apparatus in FIG. 2.

In one embodiment of the present invention, the monitoring includes measuring a characteristic parameter of the workpiece and the actuating includes actuating the ram 20 after a predetermined fixed value of the measured parameter is measured. FIGS. 2, 3, and 5 illustrate the characteristic parameter being a contact time period of the workpiece 28 with the lower die 22 and the measuring includes starting to measure the contact time period of the workpiece with the lower die as soon as contact is made between the workpiece and the lower die. The ram 20 is actuated to have the impact to occur at a predetermined fixed period of time after the contact is made. An electrical starting circuit 40 includes a timer 41 in a preferably digital electronic controller 42 which controls the press 10 and actuates the ram 20. The operator 34 manually places the workpiece 28 or pre-form 30 on the lower die 22 with the tongs 38. The electrical starting circuit 40 includes a wire 44 stretched across the front 46 of the press 10 and the lower die 22. The operator 34 completes the electrical starting circuit 40 by having the tongs 38 make and stay in contact with the wire 44 near the lower die 22 as the workpiece is placed onto the lower die. The timer 41 in the controller 42 is initiated to start to measuring the contact time period after completing the electrical starting circuit 40 in series from the wire 44 through the tongs 38, the workpiece 28, and the lower die 22. The timer 41 may be set to start when contact is made and the electrical circuit 40 is completed or after the circuit is broken preferably when the operator removes the tongs 38 from contact with the workpiece 28 while the tongs are still in contact with the wire 44.

Figure 6:
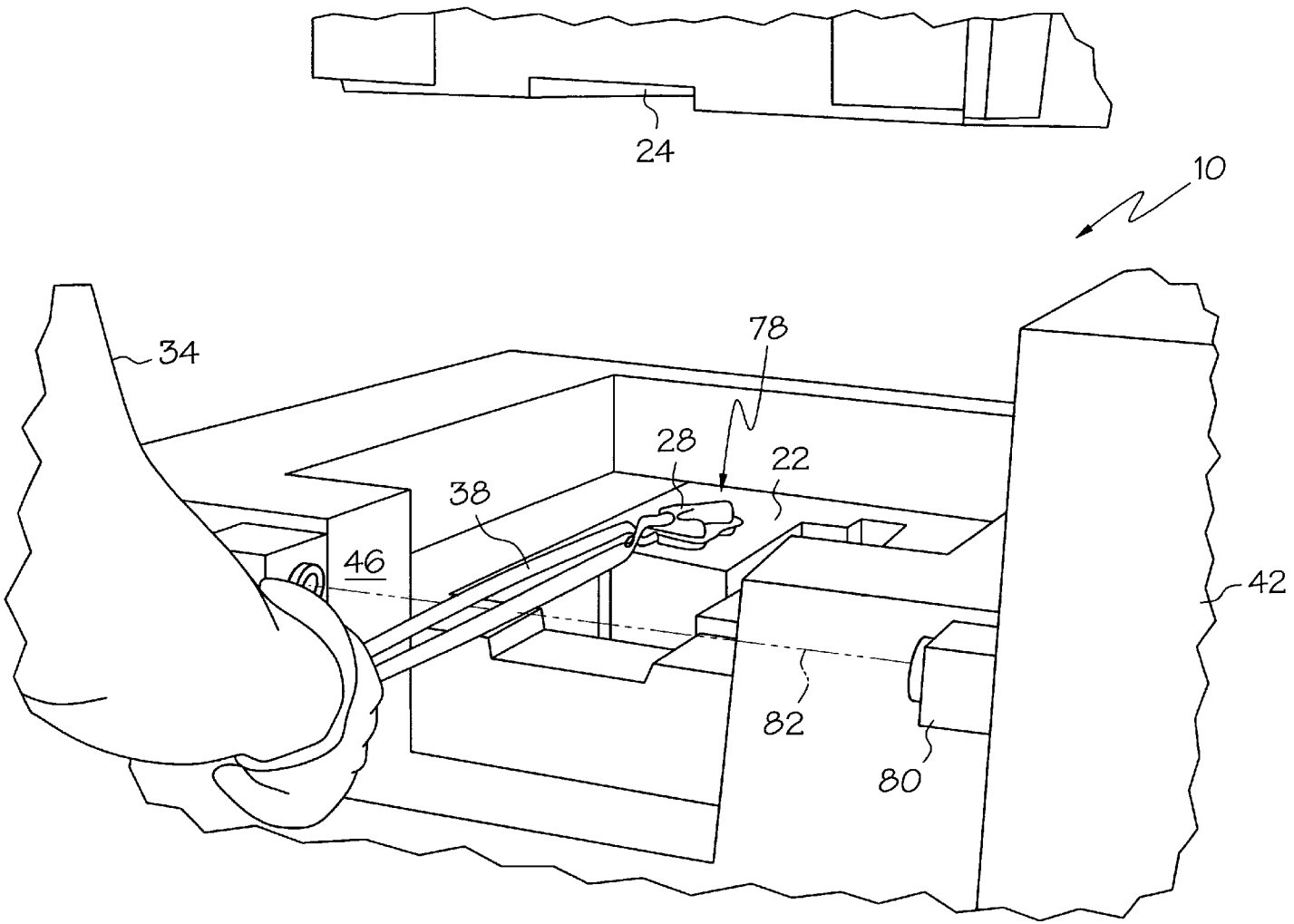
FIG. 6 is a perspective schematical illustration of a first alternative embodiment of a forge press apparatus of the present invention having an electric eye used to start a timer.

Illustrated in FIG. 6 is another embodiment of the invention uses a location of the workpiece 28 on the lower die 22 as the characteristic parameter and the measuring includes detecting whether the workpiece is at a predetermined and fixed location 78 on the lower die, and actuating includes actuating the ram to effect the impact after the workpiece is at the predetermined and fixed location on the lower die. An electric eye 80 with a light curtain 82 is used in a more particular embodiment to detect when the workpiece 28 is at the predetermined and fixed location 78 on the lower die and start the timer 41 that actuates the ram to effect the impact at a predetermined fixed period of time after the timer starts. Preferably, the embodiment includes breaking a light curtain of the electric eye during the placing of the workpiece on the lower die to start the monitoring and the timer 41 is started by re-establishing the light curtain after placing the unformed workpiece on a lower die.

Figure 7:
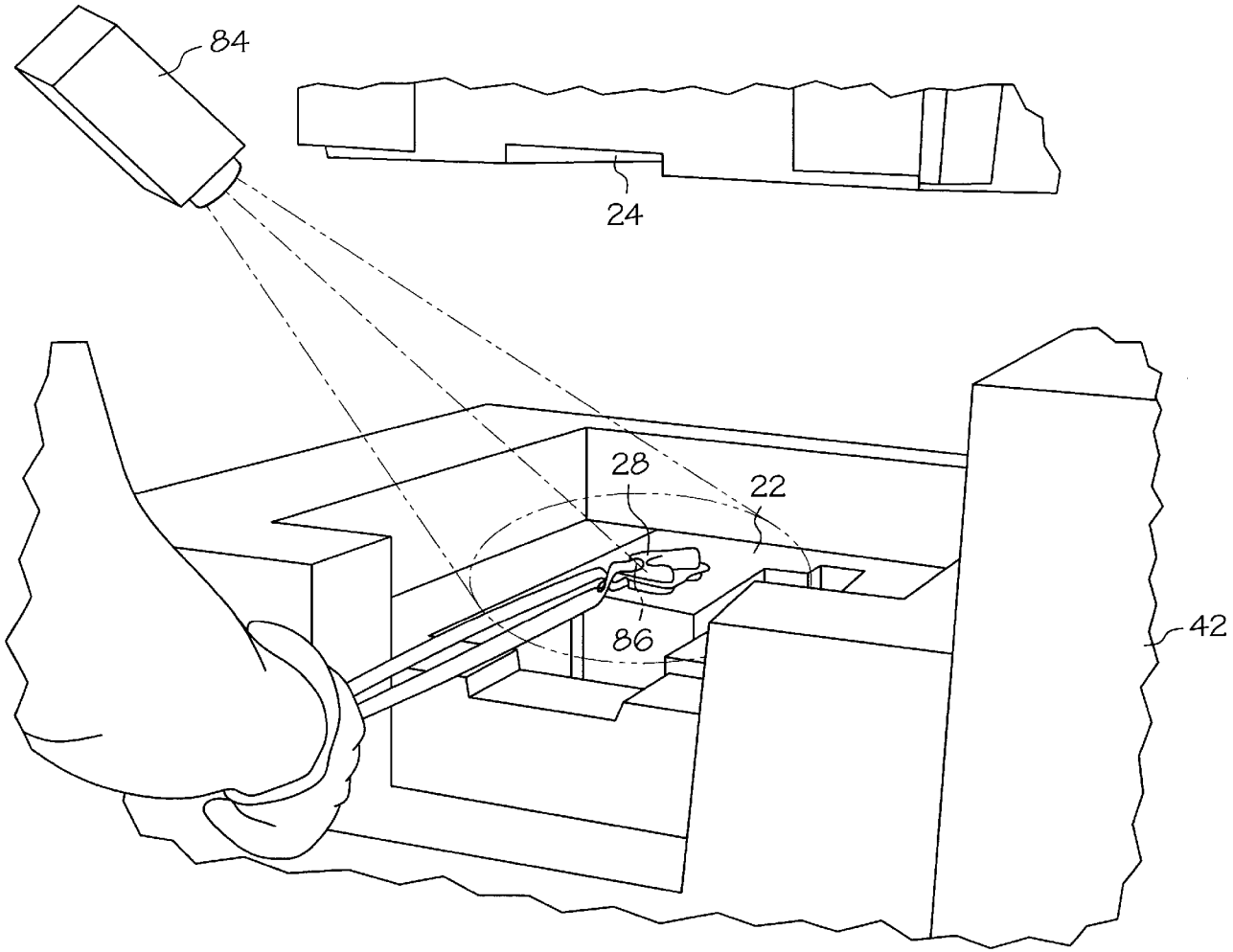
FIG. 7 is a perspective schematical illustration of a second alternative embodiment of a forge press apparatus of the present invention having an infrared camera used to start a timer.

Illustrated in FIG. 7 is yet another embodiment of the present invention in which the characteristic parameter is an actual transient temperature and the measuring comprises measuring the transient temperature with an infrared detector 84 aimed at a predetermined and fixed position 86 on the workpiece 28. The ram 20 is actuated to have the impact to occur at a predetermined fixed period of time after a predetermined fixed temperature is sensed by the infrared detector 84.

The press 10 may also be a trim press to trim the formed workpiece or a part to remove excess material such as flash attached to the workpiece after it has been formed in the forge press or other type of press incorporating the features of the present invention. The press with the infrared detector 84 is particularly suitable for trimming. The IR detector 84 is placed with a direct view of the workpiece 28 as it would be place on the lower die 22. A "dummy workpiece" with a circle or other mark inscribed on it or a hole drilled in it marks the focal point of a lens of the IR detector 84. The IR detector 84 is aligned to this target mark. The IR detector 84 includes a trigger device which closes a circuit at the point the temperature measure by the detector falls below the predetermined fixed temperature. The closing of the circuit actuates the ram 20 which operates to remove the flash by impacting the upper dies against the workpiece 28. Safety devices typically built into the controller 42 are not overridden. The controller requires the clearing of safety interrupts before the ram 20 is actuated. The predetermined fixed temperature is obtained by trial and error with a typical goal to ensure that a 99% probability of repeatability of part tolerances such as orientation of portions of the part. In the case of an airfoil of a gas turbine engine blade this means a 99% probability of no variations in tolerances in the orientation of the airfoil with respect to the dovetail and platform and in the chord length of the airfoil. An indicator light is preferably included to alert the operator when the part was trimmed at a temperature lower than the predetermined fixed temperature because of an inadvertent delay or other reason.

While the preferred embodiment of the present invention has been described fully in order to explain its principles, it is understood that various modifications or alterations may be made to the preferred embodiment without departing from the scope of the invention as set forth in the appended claims.

What is claimed is:

1. A method for activating a ram in a press having a lower die and an upper die connected to a ram, said method comprising:

heating a workpiece to a first temperature above an impact temperature, placing the heated workpiece on the lower die, monitoring the workpiece during chill down of the workpiece from the first temperature, and actuating the ram based upon said monitoring in a controlled manner to effect an impact of the upper die against the workpiece.

2. A method as claimed in claim 1 wherein said monitoring comprises measuring a characteristic parameter of the workpiece, and said actuating the ram based upon said monitoring comprises actuating the ram after a predetermined fixed value of the measured parameter is measured.

3. A method as claimed in claim 2 wherein said placing the workpiece on the lower die is done manually.

4. A method as claimed in claim 3 wherein the characteristic parameter is a contact time period of the workpiece with the lower die and said measuring includes starting to measure the contact time period of the workpiece with the lower die as soon as contact is made between the workpiece and the lower die, and actuating includes actuating the ram to effect said impact occur at a predetermined fixed period of time after the contact is made.

5. A method as claimed in claim 4 further comprising:

an operator manually placing the workpiece on the lower die with a holding tool, having the tool make and stay in contact with a wire near the lower die as the workpiece is placed onto the lower die, and the starting to measure the contact time period is initiated by completing an electrical starting circuit from the wire through the tool, the workpiece, and the lower die.

6. A method as claimed in claim 3 wherein the characteristic parameter is an actual transient temperature and said measuring comprises measuring the transient temperature with an infrared detector aimed at a predetermined and fixed position on the workpiece, and actuating includes actuating the ram to effect said impact after a predetermined fixed temperature is sensed by the infrared detector.

7. A method as claimed in claim 3 wherein the characteristic parameter is a location of the workpiece on the lower die and said measuring comprises detecting whether the workpiece is at a predetermined and fixed location on the lower die, and actuating the ram to effect said impact is initiated after the workpiece is at the predetermined and fixed location on the lower die.

8. A method as claimed in claim 7 wherein an electric eye is used to detect when the workpiece is at the predetermined and fixed location on the lower die and to start a timer to actuate the ram to effect said impact at a predetermined fixed period of time after the timer starts.

9. A method as claimed in claim 8 further comprising breaking a light curtain of the electric eye during the placing the unformed workpiece on the lower die and starting the timer by re-establishing the light curtain after placing the unformed workpiece on a lower die.

10. A press apparatus for forming a workpiece, said apparatus comprising:

a press hating spaced apart lower and upper dies, said press having a ram operably connected to said upper die, a measuring means for measuring a characteristic parameter of the unformed workpiece on said lower die during chill down of the workpiece from a first temperature above an impact temperature, and a control means for actuating said ram to effect an impact of said upper die against the workpiece after a predetermined fixed value of said measured parameter is measured.

11. An apparatus as claimed in claim 10 wherein;

said characteristic parameter is a contact time period of the workpiece with said lower die and said measuring means includes a timing means for starting to measure the contact time period of the workpiece with said lower die as soon as contact is made between the workpiece and said lower die, and said control means is operable to actuate said ram to effect the impact at a predetermined fixed period of time after the contact is made.

12. An apparatus as claimed in claim 11 further comprising:

a wire near said lower die, and an electrical starting circuit including said wire for starting said timing means after said circuit is completed wherein said circuit includes in serial relationship said wire, said workpiece, and said die.

13. An apparatus as claimed in claim 11 further comprising:

a wire near said lower die, an electrical starting circuit including said wire for starting said timing means after said circuit is completed, a manually operated holding tool for an operator to place the workpiece on said lower die, and said circuit having in serial relationship said wire, said tool, said workpiece, and said die.

14. An apparatus as claimed in claim 10 wherein;

said characteristic parameter is an actual transient temperature, and said measuring means includes an infrared detector aimed to locate a predetermined and fixed position on the workpiece, and said control means is operable for actuating said ram to effect the impact after said predetermined fixed temperature is sensed by said infrared detector.

15. An apparatus as claimed in claim 10 wherein;

said characteristic parameter is a location of the workpiece on said lower die, and said measuring means includes a location detecting means for detecting whether the workpiece is at a predetermined and fixed location on said lower die, and said control means is operable for actuating the ram to effect said impact after the workpiece is detected at said predetermined and fixed location on the lower die.

16. An apparatus as claimed in claim 15 wherein;

said position detecting means includes an electric eye, said control means is operable to detect when the workpiece is at the predetermined and fixed location on said lower die and start a timer, and said timer is operable to actuate said ram to effect the impact at a predetermined fixed period of time after said timer starts.

17. An apparatus as claimed in claim 16 wherein said control means is operable to detect a breaking of a light curtain of said electric eye when workpiece is placed on said lower die and starting said timer when said light curtain is re-established after the workpiece is placed on said lower die.

* * * * *